US007188672B2

(12) United States Patent
Berkheimer et al.

(10) Patent No.: US 7,188,672 B2
(45) Date of Patent: Mar. 13, 2007

(54) WELL STRING ASSEMBLY

(75) Inventors: Earl Eugene Berkheimer, Arcadia, OK (US); Douwe Johannes Runia, Rijswijk (NL)

(73) Assignee: Shell Oil Company, Houston, TX (US)

( * ) Notice: Subject to any disclaimer, the term of this patent is extended or adjusted under 35 U.S.C. 154(b) by 237 days.

(21) Appl. No.: 10/831,550

(22) Filed: Apr. 23, 2004

(65) Prior Publication Data

US 2005/0029017 A1 Feb. 10, 2005

(30) Foreign Application Priority Data

Apr. 24, 2003 (EP) ..... 03076196

(51) Int. Cl.
*E21B 47/01* (2006.01)
*E21B 10/00* (2006.01)

(52) U.S. Cl. ..... 166/254.2; 166/66; 175/40; 175/321

(58) Field of Classification Search ..... 175/320, 175/321, 40; 166/254.2, 66
See application file for complete search history.

(56) References Cited

U.S. PATENT DOCUMENTS

| | | | | | |
|---|---|---|---|---|---|
| 2,179,010 | A | | 11/1939 | Creighton et al. | 255/72 |
| 2,284,580 | A | | 5/1942 | Kammerer | 255/61 |
| 2,719,361 | A | * | 10/1955 | Montgomery et al. | 33/544.3 |
| 2,719,363 | A | * | 10/1955 | Montgomery et al. | 33/544.3 |
| 2,726,848 | A | * | 12/1955 | Montgomery et al. | 175/321 |
| 2,936,832 | A | | 5/1960 | Brown et al. | 166/115 |
| 2,997,119 | A | * | 8/1961 | Goodwin | 175/101 |
| 3,052,838 | A | | 9/1962 | Bennett et al. | 324/10 |
| 3,112,442 | A | | 11/1963 | Bennett | 324/1 |
| 3,169,591 | A | | 2/1965 | Worthington et al. | 175/257 |
| 3,429,387 | A | * | 2/1969 | Brown | 175/237 |
| 3,437,159 | A | | 4/1969 | Link et al. | 175/260 |
| 3,554,304 | A | | 1/1971 | Link et al. | 175/259 |
| 3,661,218 | A | | 5/1972 | Brown | 175/107 |
| 3,700,049 | A | | 10/1972 | Tiraspolsky et al. | 175/50 |
| 3,747,674 | A | | 7/1973 | Murray | 166/98 |
| 3,842,914 | A | | 10/1974 | Mott | |
| 3,872,721 | A | * | 3/1975 | Ilfrey | 73/152.28 |
| 4,204,426 | A | | 5/1980 | Patton et al. | 73/151 |

(Continued)

FOREIGN PATENT DOCUMENTS

| | | | |
|---|---|---|---|
| EP | 310215 | A1 | 4/1989 |

(Continued)

*Primary Examiner*—David Bagnell
*Assistant Examiner*—Shane Bomar

(57) ABSTRACT

A well string assembly includes an upper tubular well string part having upper and lower ends between which there is formed a passageway, a lower well string part having upper and lower ends, which lower end is spaced apart from the lower end of the upper well string part and may include a drill bit. An auxiliary tool is arranged such that it can be passed along the passageway. It comprises an operating means for manipulating the well string interconnection means so as to disconnect the lower well string part from the upper well string part. The auxiliary tool can be passed, after disconnecting the upper and lower well string parts, through an opening at the lower end of the upper well string part, so as to reach a position in which at least part of the auxiliary tool is not radially surrounded by a part of the well string.

24 Claims, 6 Drawing Sheets

U.S. PATENT DOCUMENTS

| | | | | |
|---|---|---|---|---|
| RE32,336 | E * | 1/1987 | Escaron et al. | 166/254.2 |
| 4,932,005 | A | 6/1990 | Birdwell | 367/83 |
| 5,244,050 | A | 9/1993 | Estes | 175/393 |
| 5,472,057 | A | 12/1995 | Winfree | 175/57 |
| 5,507,357 | A * | 4/1996 | Hult et al. | 175/385 |
| 5,589,825 | A | 12/1996 | Pomerleau | 340/854.9 |
| 5,695,009 | A | 12/1997 | Hipp | |
| 5,782,261 | A | 7/1998 | Becker et al. | 137/155 |
| 6,003,607 | A * | 12/1999 | Hagen et al. | 166/381 |
| 6,345,669 | B1 * | 2/2002 | Buyers et al. | 166/381 |
| 2002/0162656 | A1 | 11/2002 | Dewey | 166/117.5 |
| 2004/0026126 | A1 * | 2/2004 | Angman | 175/57 |
| 2004/0238218 | A1 * | 12/2004 | Runia et al. | 175/57 |
| 2004/0238224 | A1 * | 12/2004 | Runia | 175/339 |
| 2006/0118298 | A1 | 6/2006 | Miller et al. | 166/242.7 |

FOREIGN PATENT DOCUMENTS

| | | | |
|---|---|---|---|
| GB | 2069397 | A | 2/1981 |
| GB | 2166993 | A | 11/1984 |
| GB | 2146126 | | 4/1985 |
| WO | 00/17488 | | 3/2000 |
| WO | 03/004820 | A2 | 1/2003 |
| WO | 03/004825 | A1 | 1/2003 |
| WO | 03/010410 | A1 | 2/2003 |

* cited by examiner

WELL STRING ASSEMBLY

FIELD OF THE INVENTION

The present invention relates to a well string assembly suitable for performing an operation in relation to a borehole and/or earth formation external of the well string in the borehole.

BACKGROUND OF THE INVENTION

The expression well string is used to refer to any string or well tubular used for operations in a borehole, such a drilling, logging, fluid transportation. The well string does not necessarily need to be tubular over its entire length. The well string can in particular be a drill string.

In the course of an operation such as drilling into an earth formation, it is sometimes desired to have access to the borehole exterior of the well string. For example, performing measurements of certain properties of the surrounding earth formation is difficult if not impossible to be done from inside a drill string. Other examples in which access to the borehole is desired include obtaining a sample of the surrounding formation, injecting a fluid such as cement or lost circulation material for prevention of fluid losses, or performing a cleaning operation such as the removal of mudcake from the borehole wall e.g. by jet cleaning.

If it is known at the start of the drilling operation what operations need to be performed, it is sometimes possible to include specialised equipment in the well string, such as a dedicated Measurement-While-Drilling (MWD) tool. Such specialised equipment is expensive, and often the need for specialised equipment is only encountered in the course of the drilling operation. In such cases the drill string has to be pulled up to surface so that a special tool can be mounted before the drill string is run into the borehole again.

International patent application with publication No. WO 00/17488 discloses a system for drilling and logging of a wellbore formed in an earth formation, wherein a logging tool can be lowered in the wellbore from inside a tubular drill string through a drill bit at the lower end of the drill string.

The drill bit includes a bit body provided with a passageway for the logging tool, and a closure element for the passageway in the form of an insert section at the bit face. The bit body is attached to the drill string at a drill-string side of the bit body, and the passageway extends from an opening at the drill-string side to the well exterior of the bit body. The closure element comprises a primary latching device for selectively connecting the closure element to the bit body, so as to selectively close the passageway.

The known system further comprises an auxiliary tool for manipulating the closure element, which auxiliary tool forms the lower part of a logging tool string.

The logging tool string of the known system is arranged so that it can pass from the attached well string through the opening of the bit body at the drill-string side, along the passageway so that it can reach the closure element, when the closure element is connected to the bit body. The auxiliary tool comprises a secondary latching device for selectively connecting the auxiliary tool to the closure element. The secondary latching device is further so arranged that simultaneously with the latching of the auxiliary tool to the closure element, the primary latching mechanism is operated so that the closure element is unlatched from the bit body while remaining attached to the auxiliary tool.

The drill bit of the known system can be used for drilling operation, when the closure element is connected to the bit body. When it is desired to log the formation, drilling operation is stopped, and the logging tool string with the auxiliary tool at its lower end is lowered through the well string into the passageway. The secondary latching device is connected to the closure element, and, simultaneously, the primary latching device is operated so as to release the closure element from the bit body. Then, the logging tool can be lowered into the wellbore ahead of the well drilling bit from where logging can be performed. After logging has been completed, the logging tool string can be pulled back into the well string, so that the closure element is reconnected to the bit body and the auxiliary tool is simultaneously disconnected from the closure element.

Although the known system allows access to the open borehole ahead of the drill bit in the course of a drilling operation with a logging tool, it has the disadvantage that a special drill bit provided with passageway and removable closure element is required.

SUMMARY OF THE INVENTION

To this end the present invention provides a well string assembly comprising:

an upper tubular well string part having upper and lower ends between which there is formed a passageway;

a lower well string part having upper and lower ends, which lower end is spaced apart from the lower end of the upper well string part and which lower end is connectable to or includes a drill bit;

a releasable well string interconnection means for selectively interconnecting the lower and upper well string parts above the lower end of the lower well string part; and an auxiliary tool arranged such that it can be passed along the passageway of the upper well string part, wherein the auxiliary tool comprises an operating means for manipulating the well string interconnection means so as to disconnect the lower well string part from the upper well string part, and wherein the auxiliary tool is arranged such that it can be passed, after disconnecting the upper and lower well string parts, through an opening at the lower end of the upper well string part, so as to reach a working position in which at least part of the auxiliary tool is not radially surrounded by a part of the well string.

In the specification and in the claims the terms upper/upwards and lower/downwards are used in relation to a well string in a borehole such that upper means closer to the surface (along the borehole and irrespective of its trajectory) than lower. The terms upwards and downwards are used to refer to the respective direction.

The present invention is based on the insight gained by Applicant that access to the borehole can be provided by opening up the well string above the drill bit at the lower end of the lower well string part, such that no special drill bit is required. Operations in the open borehole outside of the well string can be performed through the opening at the lower end of the upper part of the well string assembly. Any conventional drill bit including PDC bits, roller cone bits, coring bits, reamers can be used together with the present invention, as can other tools that are connectable to the lower end of a drill string where normally a drill bit can be arranged. A drill bit can be connectable directly to the lower end of the lower well string part, or via a further length of well string including, e.g., ordinary drill pipe or elements of a bottom hole assembly.

Suitably, the auxiliary tool further comprises a lower well string connection means for connecting the auxiliary tool to the lower well string part, simultaneously with or before disconnecting the well string interconnection means. In this way it can be arranged that the lower well string part is not lost in the borehole after disconnecting.

If the auxiliary tool comprises a hang-off device co-operating with the lower end of the upper well string part, the auxiliary tool itself, suitably with the lower well string part connected to its lower end, cannot be lost in the hole.

Preferably, the well string assembly is arranged such that the lower well string part can be re-connected to the upper well string part, suitably by pulling the auxiliary tool upwardly again after the operation in the borehole has been performed.

In a preferred embodiment the upper and lower parts of the well string can be telescopically opened and closed with the auxiliary tool as central part.

The operation in relation to the borehole or formation surrounding the auxiliary tool can be performed by a further specialised tool operating through the auxiliary tool in its working position, to which end the auxiliary tool can be provided with a suitable opening. A further specialised tool can e.g. be a logging tool, an inspection tool, a sampling tool, a fluid injection tool, a cleaning tool, a placement tool for placing of equipment into the borehole, such as a packer. The further specialised tool can e.g. be lowered from surface into the auxiliary tool in its working position. The auxiliary tool itself can also be integrated with the further specialised tool, i.e. it can include suitable means for performing the desired operation, such that the auxiliary tool performs a double function of opening the well string and performing the desired operation. It is possible to provide several auxiliary tools for different operations, each of which is however able to open up the well string by manipulating the interconnection means. Each integrated auxiliary tool can for example be formed of a first module that serves for connecting/disconnecting functions, releasably connected to a second module including the specialised tool, so that for a particular operation the first module is connected to a suitable second module for that operation.

BRIEF DESCRIPTION OF THE FIGURES

The invention will now be described in more detail and with reference to the drawings, wherein.

DESCRIPTION OF AN EMBODIMENT OF THE INVENTION

Figure 1:
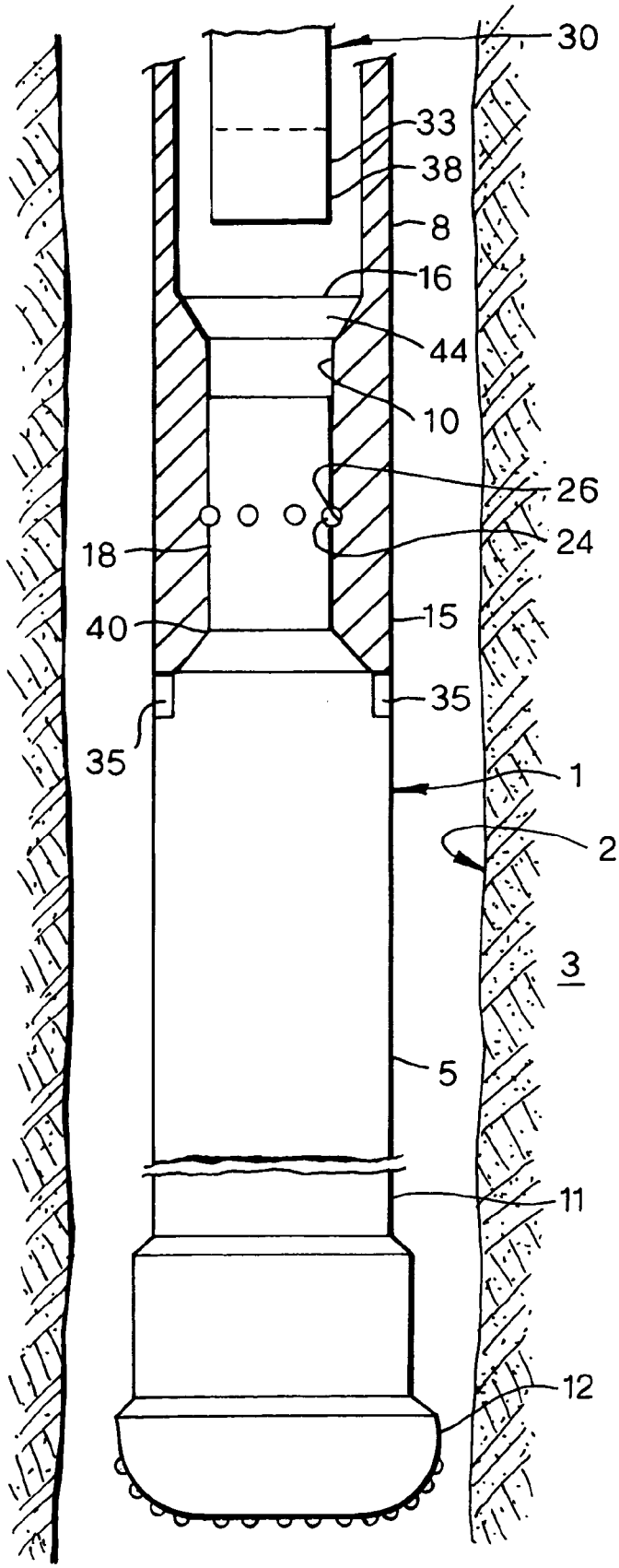
FIG. 1 shows schematically an embodiment of a well string assembly according to the present invention wherein the upper and lower well string parts are interconnected.

When like reference numerals are used in the various Figures they refer to substantially similar parts.

Reference is made to FIG. 1, showing schematically a well string assembly 1 according to the invention when arranged in a borehole 2 penetrating a subsurface formation 3. In FIG. 1 the lower well string part 5 is shown connected to the upper well string part 8. The lower well string part 5 has an upper end 10 and a lower end 11, and at the lower end in this case a conventional drill bit 12 is attached. The lower well string part 5 can also include a length of conventional drill pipe as well as other elements of a bottom hole assembly such as a drill collar, directional steering devices, mud motor, measurement-while-drilling system (not shown). The lower well string part does not need to have a large diameter longitudinal passageway, but it can of course have such a passageway over a certain length.

The upper well string part 8 has a lower end 15 above, i.e. spaced apart from, the lower end of the lower well string part, when the upper and lower well string parts are connected to each other during normal operation as shown in FIG. 1. The upper well string part extends to surface so that its upper end is not shown in the Figure. The upper well string part 8 is tubular, so that a longitudinal passageway 16 is formed between its upper and lower ends.

The upper and lower well string parts are releasably interconnected by a well string interconnection means 18, which is formed by a latch mechanism of co-operating parts at the upper end 10 of the lower well string part 5 and the lower end 15 of the upper well string part 8. The latch mechanism is only schematically indicated in FIG. 1 by locking balls 24 on the lower well string part co-operating with a locking recess or recesses 26 inside the tubular upper well string part 8. An example of the interconnecting means will be described in more detail with reference to FIG. 3.

The well string assembly 1 further comprises an auxiliary tool 30 that can be passed along the passageway 16 of the upper well string part 8, wherein the auxiliary tool 30 comprises an operating means 33 for manipulating the well string interconnection means 18 so as to disconnect the lower well string part 5 from the upper well string part 8. An example of an auxiliary tool with operating means will be discussed in more detail with reference to FIGS. 4–6.

The upper and/or lower well string parts are provided with means 35 for rotationally locking the well string parts relative to each other when they are interconnected. This is needed in order to be able to transmit torque to the lower well string part by rotating the upper well string part when the parts are interconnected. The locking means can have the form of one or more locking fingers or keys cooperating with a suitable recess on the other well string part.

Figure 2:
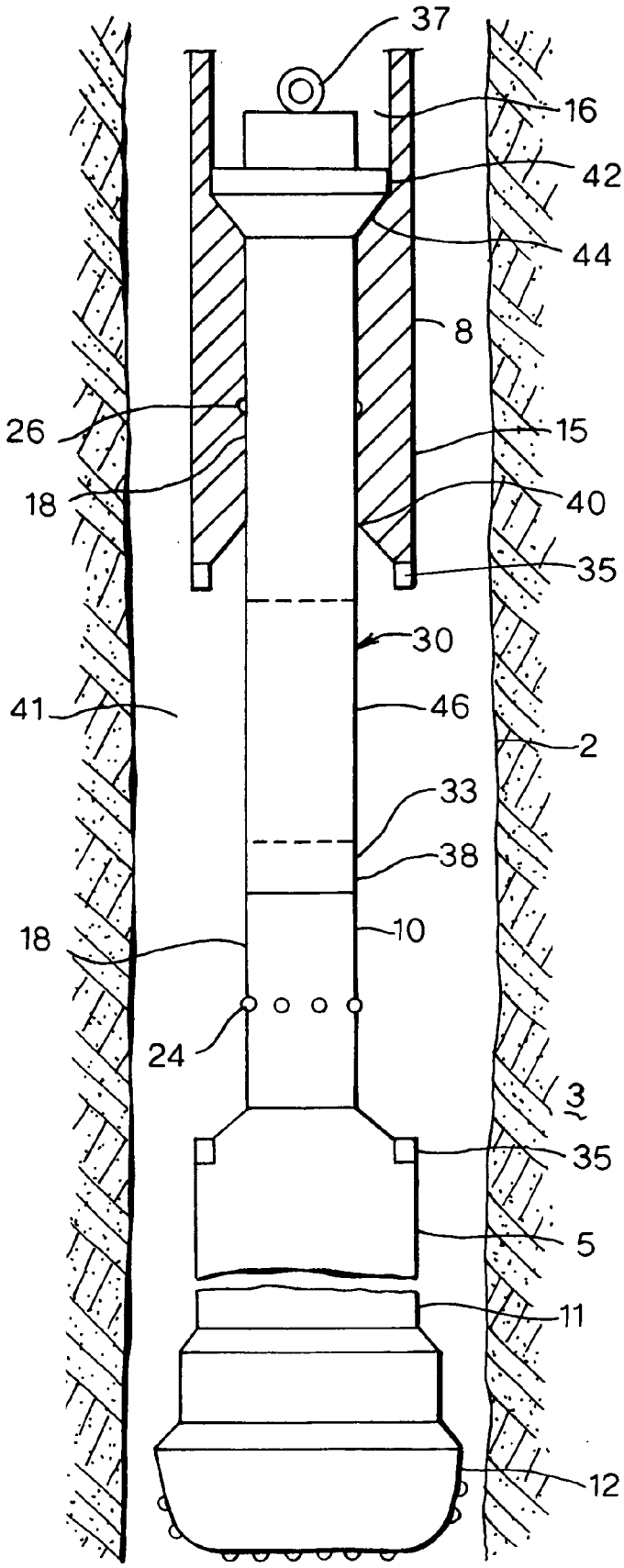
FIG. 2 shows schematically the well string assembly of FIG. 1 after disconnecting the upper and lower well string parts.

Reference is made to FIG. 2, showing schematically the well string assembly 1 of FIG. 1 after the well string interconnection means 18 was operated by the auxiliary tool 30, by lowering the auxiliary tool. Lowering can be done by means of the fishing neck 37 be means of wireline or coiled tubing, or by using a special deployment tool such as a pumping tool.

The auxiliary tool 30 of this example further comprises a lower well string connection means 38 which is arranged such that it connects the auxiliary tool 30 to the lower well string part 5, simultaneously with or before disconnecting the well string interconnection means 18 by operating means 33. An example of a lower drill string connection means is discussed with reference to FIGS. 3–9.

FIG. 2 shows the well string assembly 1 in a situation wherein the auxiliary tool 30 has been passed on through the opening 40 at the lower end of the upper well string part 8, to reach a working position as shown, wherein the auxiliary tool extends into a region 41 of the borehole 2 external of the well string, where part of the auxiliary tool is not radially or laterally surrounded by any of the well string parts. Neither the upper or the lower well string part surrounds this part of the tool from all radial directions. I.e. the auxiliary tool is not annularly enclosed in this working position, such that there is free access to at least part of the borehole and borehole wall. It shall be clear that the borehole wall can be formed by e.g. casing.

To fix the auxiliary tool in the working position, the auxiliary tool is provided with a hang-off device in form of a landing ring 42 at its upper end, which landing ring co-operates with a landing shoulder 44 in the upper well string part 8.

The auxiliary tool 30 further comprises a logging tool 46 on the part that is not surrounded by the well string 1 when the well string has been opened up and the auxiliary tool is in the working position as shown. It shall be clear, that instead of a logging tool 46 also another means for performing an operation in relation to the borehole or formation surrounding the auxiliary tool can be arranged, for example as a module that can be arranged instead of the logging tool module. Alternatively, the part indicated with reference numeral 46 only provides an opening or window (not shown) through which a further specialised tool can operate, which further specialised tool is lowered into the auxiliary tool.

Figure 3:
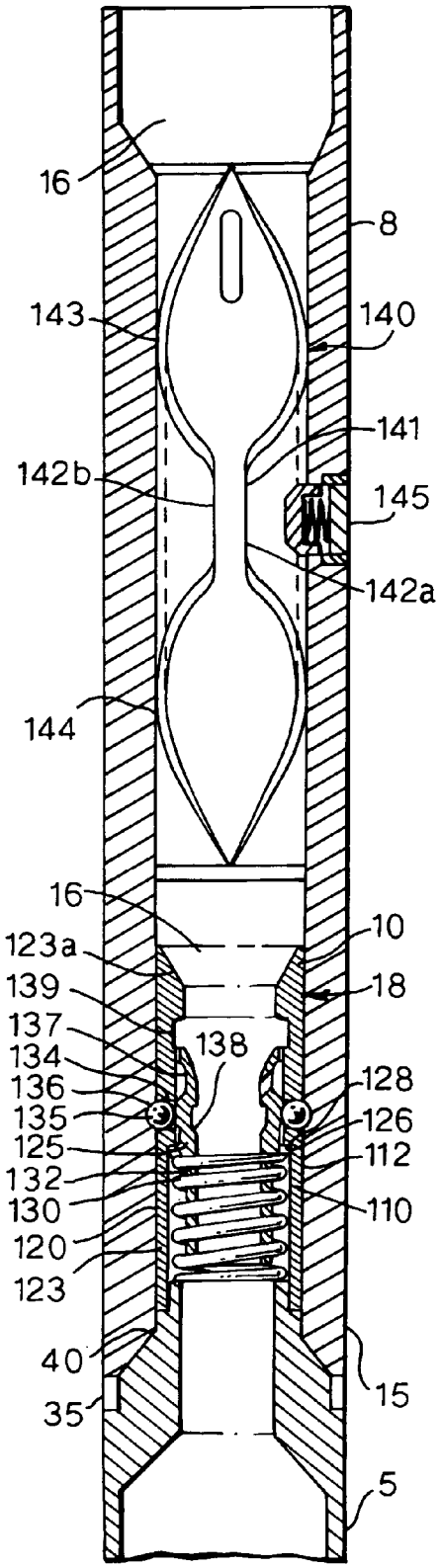
FIG. 3 shows schematically an embodiment of an interconnection means for use with the present invention.

Reference is made to FIG. 3 showing an example of the interconnection means 18 in more detail in longitudinal cross-section, when the upper and lower well string parts are interconnected as in FIG. 1.

The interconnection means 18 is formed by a latching device 110 at the upper end 10 of the lower well string part 5, co-operating with a section 112 at the lower end 15 of the upper well string part 8.

The latching device 110 of the lower well string part 5 has substantially cylindrical shape and extends into a central longitudinal bore 120 in the section 112 with narrow clearance. The bore 120 forms part of the passageway 16 and has an opening 40 at its lower end.

The latching device 110 is removably connected to the upper well string part 8. The latching section 110 comprises a substantially cylindrical outer sleeve 123, which extends with narrow clearance along the bore 120. The latching section 110 further comprises an inner sleeve 125, which slidingly fits into the outer sleeve 123. The inner sleeve 125 is provided with an annular rim 126, which is biased in upward direction against an inward shoulder 128 of the outer sleeve 123. The biasing force is exerted by a partly compressed helical spring 130, which pushes the inner sleeve 125 in upward direction. At its lower end the inner sleeve 125 is provided with an annular recess 132 which is arranged to embrace the upper part of spring 130.

The outer sleeve 123 is provided with recesses 134 wherein locking balls 135 are arranged. A locking ball 135 has a larger diameter than the thickness of the wall of the sleeve 123, and each recess 134 is arranged to hold the respective ball 135 loosely so that it can move a limited distance radially in and out of the sleeve 123. Two locking balls 135 are shown in the drawing, however it will be clear that more locking balls can be arranged. As an alternative for locking balls, locking dogs can be used.

In the interconnected position as shown in FIG. 3 the locking balls 135 are pushed radially outwardly by the inner sleeve 125, and register with the annular recess 136 arranged in the section 112 internally around the bore 120. In this way the latching device 110 and therefore the lower well string part 5 is locked to the upper well string part 8.

The inner sleeve 125 is further provided with an annular recess 137, which is, in the interconnecting position, longitudinally displaced with respect to the recess 136 in upward direction. There can also be provided inner recesses 138. As will be explained in more detail below, the interconnecting means can be operated by inducing a longitudinal motion of the inner sleeve 125 with respect to the outer sleeve 123, because in this way the locking balls 135 can be locked into and released from the groove 136.

The upper end 123*a* of the outer sleeve 123 is funnel-shaped so as to guide the auxiliary tool into the latching section 110, which auxiliary tool serves to connect to the lower well string part and to operate the well string interconnection means. Latching recesses 139 are arranged in the outer sleeve 123, so as to co-operate with the lower well string connection means 38 on the auxiliary tool 30 (see below).

The section 112 further comprises a two-way orienting device 140 and a spring-biased activation button 145, which are both arranged to co-operate with the auxiliary tool which can be deployed through the passageway 16 for manipulating the interconnection means 18. The orienting device 140 comprises a guiding groove 141 formed by inwardly extending rims 142*a*, 142*b*, which extend in upper and lower direction fully around the circumference of the passageway 16, to form an upper camming rim 143 and a lower camming rim 144. The orienting device 140 is drawn as shown in FIG. 3 for the sake of clarity, suitably however it is oriented such that the guiding groove 141 is arranged opposite the button 145.

An embodiment of the auxiliary tool co-operating with the interconnection means of FIG. 3 will now be discussed.

Figure 4:
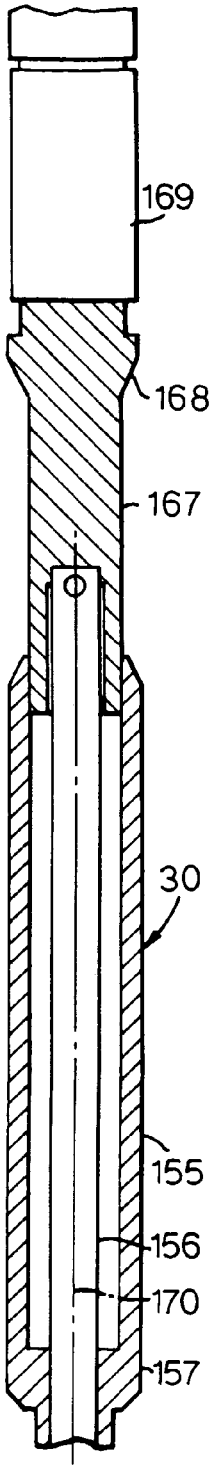
FIG. 4 shows schematically an embodiment of the upper part of an auxiliary tool.
Figure 6:
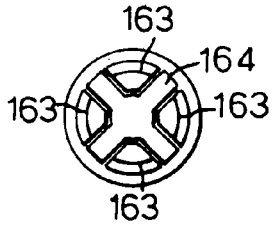
FIG. 6 shows schematically a cross-section taken at VI—VI in FIG. 5.
Figure 5:
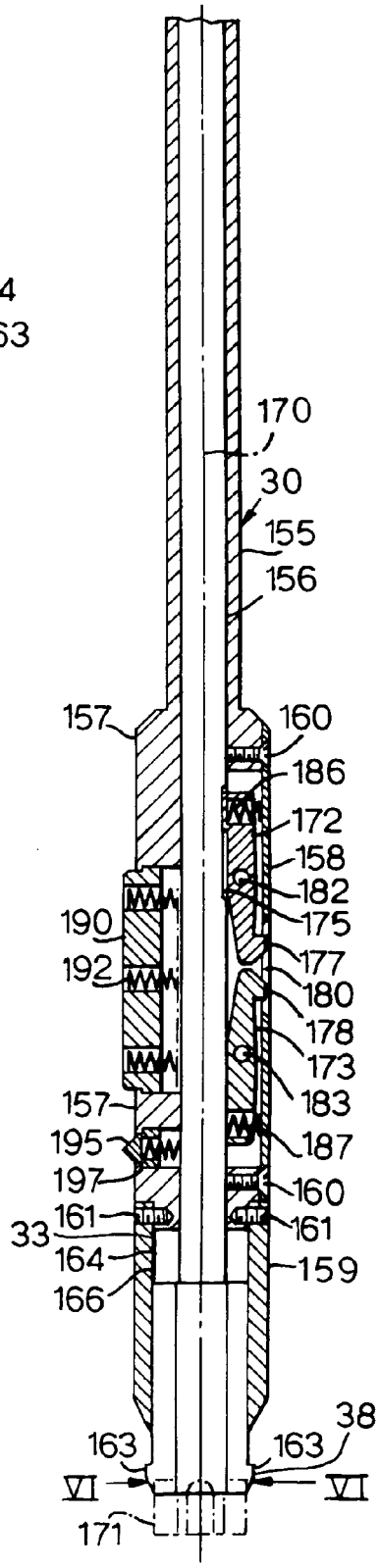
FIG. 5 shows schematically the downstream part of the auxiliary tool of FIG. 4.

Reference is made to FIGS. 4–6. FIG. 4 shows schematically the upper part of an auxiliary tool, and FIG. 5 the lower part of an auxiliary tool in longitudinal cross-section. FIG. 6 shows a cross-section taken at VI—VI in FIG. 5.

The auxiliary tool 30 for manipulating the interconnection means 18 is arranged so that it can pass from surface through the interior of the upper well string part 8, along the passageway 16 to the interconnection means 18, when the upper and lower well string parts are connected as shown in FIGS. 1 and 3. To this end the auxiliary tool is elongated and substantially cylindrical having a maximum outer diameter of less than the inner diameter of the upper well string part 8. The lowermost part of the auxiliary tool has a maximum outer diameter of less than the minimum diameter of the passageway. A typical minimum diameter of the passageway is 6 cm (2.5 inch), when the upper well string part a diameter of as low as 9 cm (3.5 inch), or of course larger.

The auxiliary tool comprises a first, outer member 155 and a second member in the form of inner piston 156. The outer member 155 of this example has a housing formed by parts 157,158,159, which are assembled by screws 160,161. The outer member 155 includes a lower well string connecting means 38 at its lowermost end. The lower well string connection means includes four latching petals 163, which are arranged to co-operate with the latching recesses 139 in the latching device 110 of the lower well string part 5, so as to selectively and releasably connect the auxiliary tool to the lower well string part.

The inner piston 156 is provided with an operating means 33 at its lower end, in the form of a plunger 164. The plunger 164 has a cross-shaped cross-section at its lowermost end, as is best visible in FIG. 6, and serves to longitudinally shift the inner sleeve 125 with respect to the outer sleeve 123 of the latching section. To this end the inner piston 156 is longitudinally movable with respect to the outer member 155. The plunger 164 is shown at 166 in a first, retracted position. This position at the same time characterizes the relative position between the first, outer member 156 and the inner piston (second member) 156. This is also visible from the upper part of the auxiliary tool 30 in FIG. 4, wherein the shaft 167 that is connected to the upper part of the inner piston 156 is fully retracted from the upper part of the outer member 155. The shaft 167 has a shoulder 168, and is connected via a swivel 169 to other equipment (not shown) forming part of or being connected to the upper end of the auxiliary tool 30. The swivel allows free rotation of such other equipment.

With the plunger in this retracted position, the latching petals 163 of the outer member 155 have transverse flexibility towards the axis 170 of the auxiliary tool, so that they can enter into the latching section 110 and connect into the latching recesses 139. The inner piston 156 can also be longitudinally moved to assume other positions relative to the outer member 155. One such position is indicated dashed at 171, and in this position the petals 163 cannot flex anymore towards the axis.

The plunger 164 is arranged so that it can push onto the upper end of the inner sleeve 125, thereby forming an operating means 33 for the interconnecting means 18 as discussed before. This will be discussed in more detail with respect to FIGS. 7–9.

The auxiliary tool is further provided with several parts that further support fail-safe operation, in particular to further ensure that the lower well string part cannot be lost in the hole: Upper trigger 172 forming a first retaining device and lower trigger 173 forming a second retaining device are arranged on the outer member 155 to co-operate with a recess 175 on the inner piston 156 and with the button 145 in section 112 of the upper well string part 8, as will be explained in more detail below. The triggers 172 and 173 are provided with notches 177, 178 extending through an opening 180 in the housing 158, and are pivotably mounted about axes 182,183, wherein the ends opposite the notches are biased in the direction of the inner piston 156 by means of a spring 186,187.

The housing is further provided with a key 190 projecting out of the substantially cylindrical outer surface of the lower part of the outer member 155, co-operating with the two-way orienting tool 140 of the upper string part 8. The key 190 is elongated, parallel to the direction of the axis 170, and has tapered edges giving it a boat-like shape. The key is supported by springs 192. Instead of the boat-shaped elongated key also two separate keys that are longitudinally spaced apart can be arranged. Below the key 190 and slightly angularly displaced there is an anti-collision button in the form of a radially outwardly extending tip 195 supported by a spring 197.

The inner piston 156 can further be provided with fingers (not shown for the sake of clarity) extending below the plunger 164, which fingers can co-operate with recesses 138 in the latching device 110. In this way, also the inner piston can be connected to the lower well string part in a predetermined position, which can further contribute to fail-safe operation in the event of strong longitudinally outward (downward) forces on the lower well string part 5 due to pulling or pumping.

Figure 7:
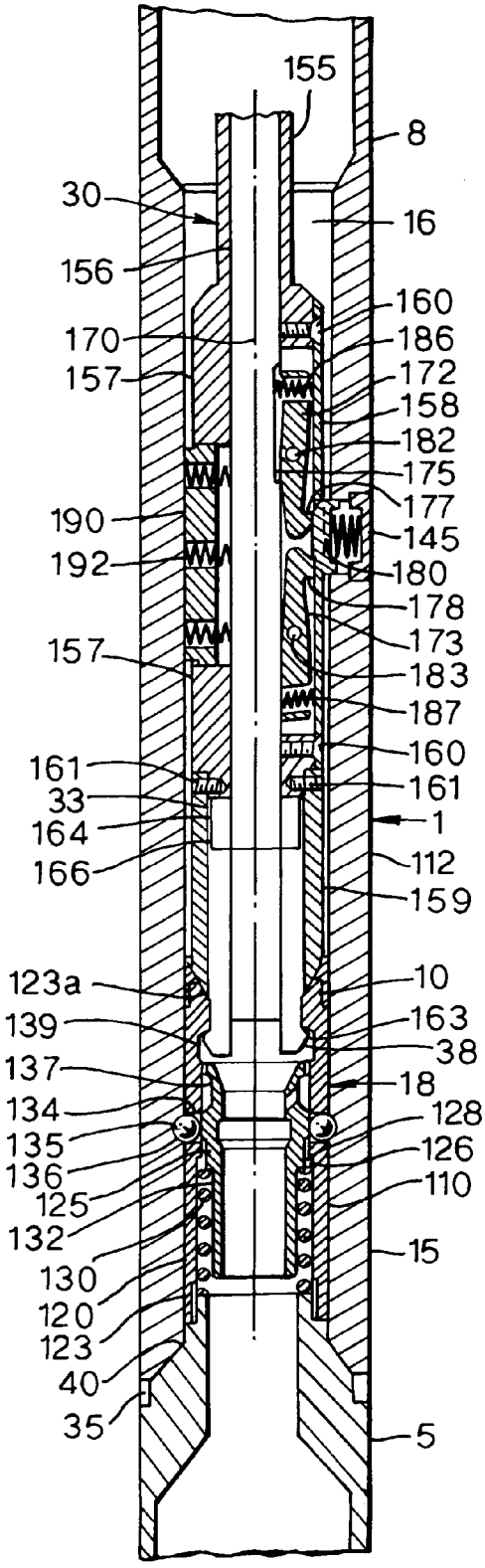
FIG. 7 shows schematically the interaction between auxiliary tool and well string in a first situation.
Figure 8:
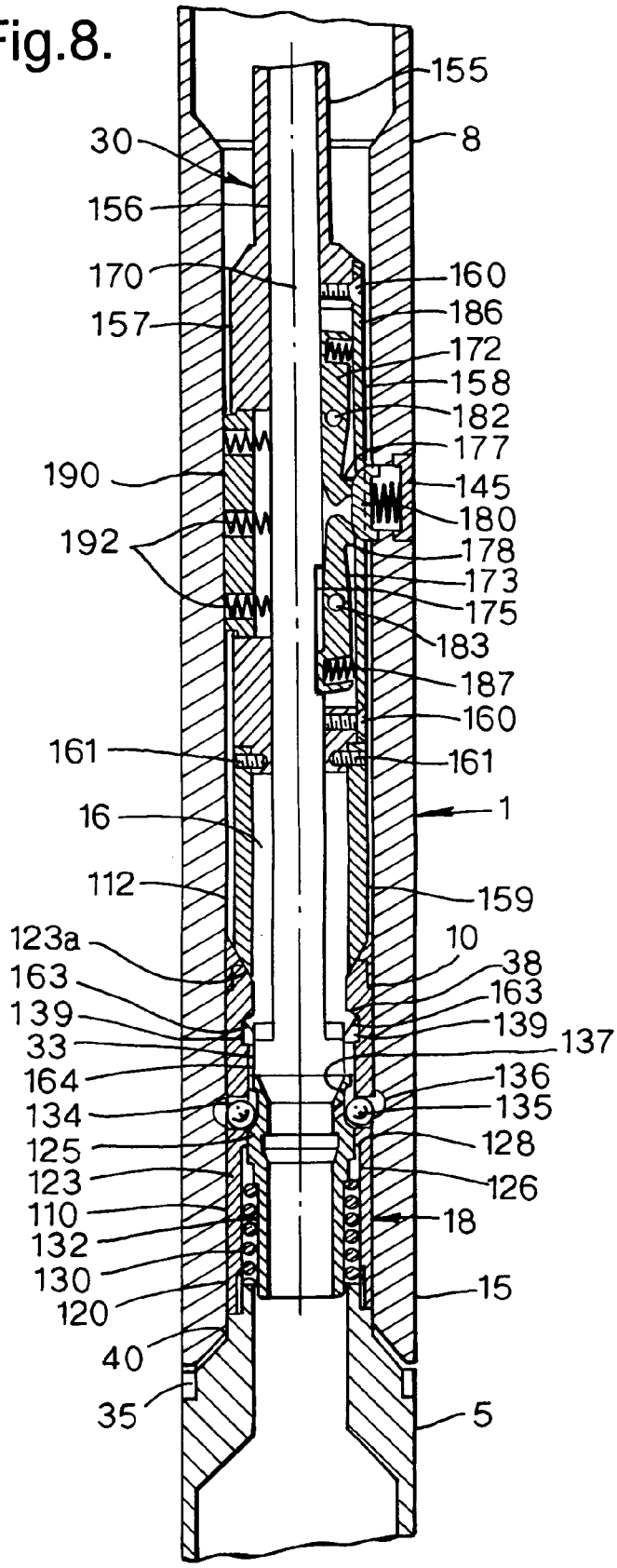
FIG. 8 shows schematically the interaction between auxiliary tool and well string in a second situation.
Figure 9:
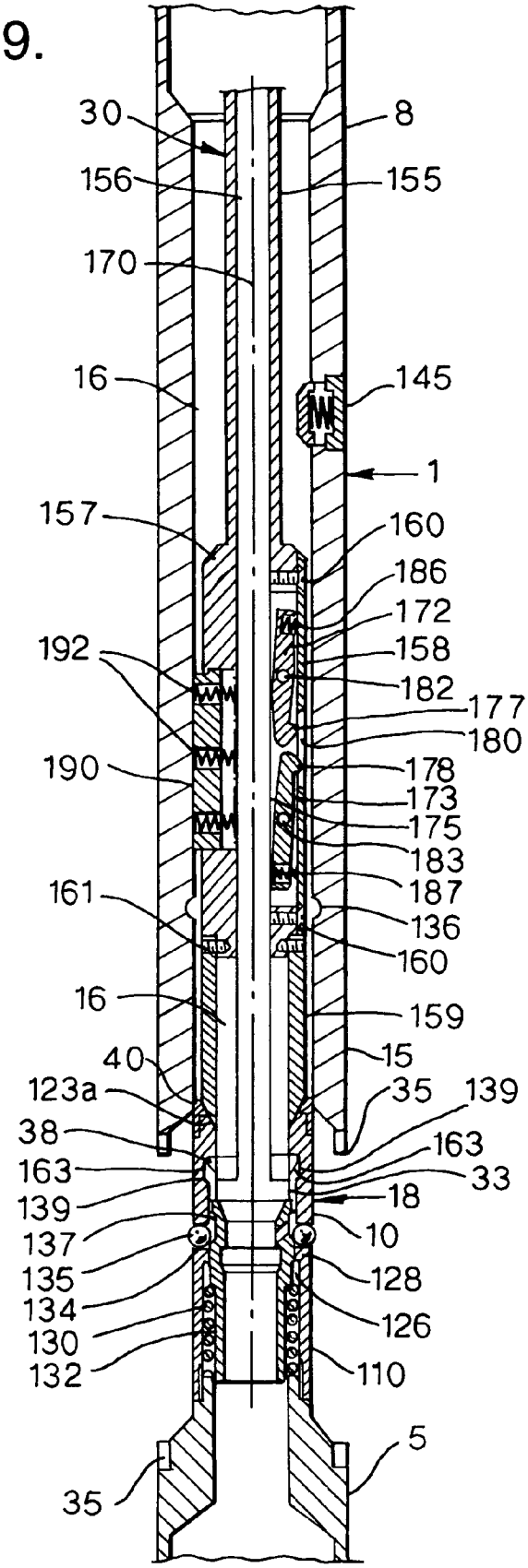
FIG. 9 shows schematically the interaction between auxiliary tool and well string in a third situation.

The function of the parts to ensure fail-safe operation will become clear from the discussion of FIGS. 7–9.

FIGS. 7–9 show several stages of the interaction between the auxiliary tool 30 and the interconnection means 18 when the interconnection means is operated so as to disconnect the upper and lower well string parts. Reference numerals correspond to those already used in connection with FIGS. 1–6.

The well string 1 with the upper and lower well string parts interconnected as shown in FIG. 1 can be used for progressing the wellbore 2.

When it is desired to perform an operation in the open borehole 2, the drill bit 12 is first positioned a distance above the bottom of the borehole. Then, the lower well string part 5 can be disconnected and lowered to create space for operation between the upper and lower well string parts.

For disconnecting, the auxiliary tool 30 is lowered from surface or from a position inside the upper well string part 8 along the passageway 16 to reach the section 112.

When lowering the auxiliary tool 30, the inner piston 156 is in its retracted position 166, which is also referred to as the first position relative to the outer member 156 in the specification and in the claims. When the lower part of the auxiliary tool enters the section 112, the key 190 engages the upper camming rim 143 (not shown in FIGS. 7–9 for the sake of clarity) and the auxiliary tool is turned about the swivel 169 so that a predetermined angular position between the lower well string connection means 38 and the latching device 110 is achieved at or just before the point where the auxiliary tool contacts the latching device 110.

The petals 163, forming the lower well string connection means on the lower end of the outer member 156, are received and guided by the funnel-shaped upper end 123*a* of the outer sleeve 23 into the latching device 110. The legs of the petals 163 are inwardly deformed until the petals 163 register with the recesses 139 so that they can snap outwardly. This position, wherein the auxiliary tool 30 is connected to the latching device 110 of the lower well string part 5 is shown in FIG. 7.

It is also clear from FIG. 7 that the button 145 has engaged the notch 177 of the upper trigger 172 (which forms a first retainer device), thereby lifting the upper end of the trigger 172 out of the recess 175. Therefore, when the petals 163 have connected into the recesses 139, the first retainer device 172 is operated (released) so that it does not block anymore downward motion of the inner piston 156.

Further pushing on the upper end of the auxiliary tool 30 will cause the inner piston 156 to slide longitudinally relative to the outer member 155. The plunger 164 engages the upper end of the inner sleeve 125, which has a smaller inner diameter than the diameter of the plunger 164. Further downward motion of the inner piston causes the inner sleeve to be pushed against the force of the spring 130, until the locking balls 135 register with the recesses 137. This situation is shown in FIG. 8. The locking balls are therefore allowed to move inwardly, thereby unlocking the lower well string part 5 from annular recess 136, i.e. from the upper well string part 8. In this way the plunger 164 forms an operating means for the interconnection means 18. The relative position between the inner piston 156 and the outer member 155 at which the locking balls are fully released from the annular recess 136 is referred to as the second relative position in the specification and in the claims.

In the position shown in FIG. 8, the inner piston 156 prevents inward flexing of the petals 163, so that the auxiliary tool 30 is securely locked to the lower well string part 5. Also, in this position the recess 175 on the inner piston has moved so far that it registers with the lower trigger 173 (second retainer device). The lower end of the lower trigger 173 is forced into the recess 175 by the action of the spring 187, and blocks the longitudinal upward motion of the inner piston 156 with respect to the outer member 56 when the closure element 10 is unlatched.

By further pushing on the auxiliary tool 30 in lower direction the lower well string part 5 is pushed away from the upper well string part. Part of the auxiliary tool reaches the open borehole and is not radially surrounded by the well string, so that an operation can be performed as discussed with reference to FIG. 2. Suitably the auxiliary tool can be hung off in the bottom hole assembly as shown in FIG. 2.

The well drilling bit 1 and auxiliary tool 30 are such designed that the lower well string part 5 can be re-latched to the upper well string part 8 if that is desired after the operation in the open borehole has been performed.

To this end the auxiliary tool is pulled in upward direction again. The lower trigger 173 interacting with the recess 175 keeps the inner piston in the position relative to the outer member 155.

The key 190 interacts with the lower camming rim 144 (which is only shown in FIG. 3 for the sake of clarity) so as to bring the lower well string part with attached auxiliary tool 30 into a predetermined angular orientation with respect to the upper well string part 8. This predetermined angular orientation needs to be provided at a different, lower position of the auxiliary tool than before, when the auxiliary tool was to engage and connect to the latching section 110. To this end the key 190 is elongated, or two keys are arranged at a suitable longitudinal spacing. In this way, orientation occurs at different longitudinal positions. This could in principle also be achieved by making the guiding groove 141 longer. The advantage of the elongated key means is that less space is needed for the orienting device 140 as part of the wellstring or drilling bit. The elongation of the key means can be chosen longer than the length of the guiding groove.

When the position shown in FIG. 8 is reached, the locking balls 135 are about to be forced back into the annular recess 136. At this position, the button 145 activates the lower trigger 173 so that it is released from the recess 175, and the inner piston 156 including the plunger 164 at its lower end can be moved in upward direction. The inner sleeve 125 including the recesses 137 shifts upwardly, and the locking balls are locked again into the annular recess 136. At this stage the bit body and closure element are interconnected again.

After interconnecting, the auxiliary tool can be disconnected again from the closure element. To this end the inner piston is moved to the position relative to the outer member as shown in FIG. 7, and no longer blocks inward flexing motion of the petals 163. Therefore, by further pulling the auxiliary tool up, e.g. from surface, the petals 193 disengage from the recesses 139, and to this end the upper edges are slightly bevelled as shown in the drawing. After pulling slightly further, the button 145 disengages from the upper trigger 172 which will subsequently prevent the inner piston from moving in downward direction again.

As shall be clear from the foregoing discussion, the embodiment of the auxiliary tool and well string discussed with reference to FIGS. 3–9 allows fail-safe opening of the well string interconnection means and the lower well string connection means, by simply passing/pushing the auxiliary tool down the upper well string part (e.g. by using tubing extending to surface or pumping). In particular it prevents that the lower part of the well string can be lost in the well bore. Also, fail-safe re-connecting is possible by simply passing/pulling the auxiliary tool up again (e.g. by tubing or wireline).

In this embodiment two functions of the auxiliary tool are decoupled, on the one hand the connection of the lower drill string part to the auxiliary tool, and on the other hand the operation of the well string interconnection means. Decoupling is achieved in a specific way, so that the interconnection means can only be operated when the auxiliary tool is connected to the lower drill string part. In this way it is prevented that the lower drill string part can be lost in the wellbore, since it can only be disconnected from the upper well string part if it is fully connected to the auxiliary tool.

Decoupling of these functions is achieved in that the auxiliary tool comprises first and second members, each of which is associated with mainly one of the functions, and which are movable relative to each other. In a first relative position between first and second members the auxiliary tool can be connected to the lower drill string part, and by moving the first and second members into their second relative position, the interconnection means is operated.

In this embodiment the lower drill string connection means is arranged near the downstream end of the first member, the operating means is arranged near the downstream end of the second member, and the second member is arranged longitudinally slideably along the passageway with respect to the first member. Suitably then in the first relative position the second member is an upper position with respect to the first member, and the second member is moved downwards when moving it towards the second relative position.

This embodiment is advantageous because it allows simple operation of the interconnection means by longitudinal motions alone. By lowering the auxiliary tool with the second member in the first relative position, the auxiliary tool can connect to lower drill string part. With a further longitudinal motion of the second member with respect to the first member, the interconnection means can be operated. Such a longitudinal motion can easily be induced.

The interaction of the auxiliary tool, the interconnection means and the lower well string connection means as discussed with reference to FIGS. 3–9 is substantially the same as the operation of the well drilling bit assembly suitable for through-bit operation as described in European patent application No. 03250243.7, not published at the priority date of the present application.

The operation of the two-way orienting device is substantially as described in European patent applications Nos. 03250243.7 and 03250242.9, not published at the priority date of the present application. Both these European patent applications were abandoned before the date of filing of the present application, and have served as priority applications for the International patent application No. PCT/EP2004/050017, into which the subject-matter of both European patent applications was included.

It shall be clear that other interconnection means and auxiliary tools can also be used with the present invention, for example similar to the latching mechanism for drill bits suitable for through-bit operation, described in International patent applications publication No. WO 00/17488 and WO 03/004825, wherein the role of the upper and lower well string parts is played by the bit body and the closure element for the longitudinal passageway in the bit body, respectively.

In some applications it may not be a problem to lose the lower drill string part in the borehole after disconnecting, so that the lower drill string connection means is not needed.

The present invention can be used to arrange that a well string can be opened up at any desired position location above its lower end. It is only required to arrange a suitable interconnection means at that position. The interconnection means does not interfere with the normal drilling operation but provides flexibility to perform an operation in the borehole. When a well string assembly is deployed in a borehole, the invention can be used to perform an operation in the borehole exterior of the well string, which can be an open borehole, or also a partly or fully completed wellbore.

The lower well string part can include all or part of the so-called bottom hole assembly of a well string.

The well string according to the present invention does not need to be provided with a drill bit at the lower end of the lower well string part. A reamer can for example be mounted, or a cementing tool. In a particular application the lower end of the lower well string part is formed by a jetting head and the lower part of the well string in this case further includes a knuckle joint. Jetting head and knuckle joint are used in re-entry systems to direct a well string into a particular branch of a multilateral well.

The invention claimed is:

1. A well string assembly comprising:

an upper tubular well string part having upper and lower ends between which there is formed a passageway;

a lower well string part having upper and lower ends, which lower end is spaced apart from the lower end of the upper well string part and which lower end is connectable to or includes a drill bit;

a releasable well string interconnection means for selectively interconnecting the lower and upper well string parts above the lower end of the lower well string part; and an auxiliary tool arranged such that it can be passed along the passageway of the upper well string part, wherein the auxiliary tool comprises an operating means for manipulating the well string interconnection means so as to disconnect the lower well string part from the upper well string part, and wherein the auxiliary tool is arranged such that it can be passed, after disconnecting the upper and lower well string parts, through an opening at the lower end of the upper well string part while suspending the lower well string part, so as to reach a working position in which at least part of the auxiliary tool is not radially surrounded by a part of the well string.

2. The well string assembly according to claim 1, wherein the auxiliary tool further comprises a lower well string connection means for connecting the auxiliary tool to the lower well string part simultaneously with or before disconnecting the well string interconnection means.

3. The well string assembly according to claim 2, wherein the interconnection means, auxiliary tool and the lower well string connection means are arranged such that the lower and upper well string parts can be reconnected again after disconnecting.

4. The well string assembly according to claim 1, wherein the auxiliary tool comprises a hang-off device co-operating with the lower end of the upper well string part.

5. The well string assembly according to claim 1, further comprising a means for performing an operation in relation to the borehole or formation surrounding the auxiliary tool, when the auxiliary tool is in the working position.

6. The well string assembly according to claim 5, wherein the means for performing an operation forms part of the auxiliary tool.

7. The well string assembly according to claim 5, wherein the means for performing an operation is selected from the group consisting of a logging tool, a sampling tool, a fluid injection tool, a placement tool.

8. A method of performing an operation in a borehole, external of the well string, comprising using the well string assembly of claim 1.

9. The well string assembly according to claim 1, wherein the interconnection means and auxiliary tool are arranged such that the lower and upper well string parts can be reconnected again after disconnecting.

10. A well string assembly comprising:

an upper tubular well string part having upper and lower ends between which there is formed a passageway;

a lower well string part having upper and lower ends, which lower end is spaced apart from the lower end of the upper well string part and which lower end is connectable to or includes a drill bit;

a releasable well string interconnection means for selectively interconnecting the lower and upper well string parts above the lower end of the lower well string part; and an auxiliary tool arranged such that it can be passed along the passageway of the upper well string part, wherein the auxiliary tool comprises an operating means for manipulating the well string interconnection means so as to disconnect the lower well string part from the upper well string part, and wherein the auxiliary tool is arranged such that it can be passed, after disconnecting the upper and lower well string parts, through an opening at the lower end of the upper well string part, so as to reach a working position in which at least part of the auxiliary tool is not radially surrounded by a part of the well string, further comprising a means for performing an operation in relation to the borehole or formation surrounding the auxiliary tool, when the auxiliary tool is in the working position, wherein the means for performing an operation is selected from the group consisting of a logging tool, a sampling tool, a fluid injection tool, a placement tool, and wherein the auxiliary tool comprises a first member which includes the lower well string connection means and a second member which includes the operating means, which second member is arranged movably so that it can assume a first and a second position relative to the first member, wherein in the first position the lower well string connection means is connectable, at least when upper and lower well string parts are interconnected, to the lower well string part without operating the well string interconnection means, and wherein after connecting the auxiliary tool to the lower well string part the well string interconnection means can be operated by moving the second member including the operating means between the first and the second position.

11. The well string assembly according to claim 10, wherein the lower well string connection means is arranged near the lower end of the first member, wherein the operating means is arranged near the lower end of the second member, and wherein the second member is arranged longitudinally slideably along the passageway with respect to the first member, so that the first relative position is an upper position of the second member, and wherein the second member is moved relative to the first member in downward direction when moving it towards the second relative position.

12. The well string assembly according to claim 11, wherein the first member of the auxiliary tool comprises a substantially tubular body in which the second member is coaxially slideably arranged, wherein the lower well string part comprises at its upper end an outer sleeve and a coaxial inner sleeve, wherein the upper end of the outer sleeve is arranged to cooperate with the lower well string connection means so as to lock the auxiliary tool to the outer sleeve, wherein the upper end of the inner sleeve is arranged to cooperate with the operating means of the auxiliary tool so that the interconnecting means is operated by longitudinally sliding the inner sleeve with respect to the outer sleeve.

13. The well string assembly according to claim 12, wherein the interconnection means, auxiliary tool and optionally lower well string connection means are arranged such that the lower and upper well string part can be reconnected again after disconnecting.

14. A method of performing an operation in a borehole, external of the well string, comprising using the well string assembly of claim 13.

15. A method of performing an operation in a borehole, comprising the steps of:

providing a well string assembly in the borehole, the well string assembly comprising an upper tubular well string part having upper and lower ends between which there is formed a passageway and a lower well string part having upper and lower ends, which lower end is spaced apart from the lower end of the upper well string part and which lower end is connectable to or includes a drill bit;

passing an auxiliary tool along the passageway of the upper well string part, thereby manipulating a well string interconnection means and thereby disconnecting the lower well string part from the upper well string part;

subsequently passing the auxiliary tool through an opening at the lower end of the upper well string part while suspending the lower well string part by the auxiliary tool;

bringing the auxiliary tool in a working position in which at least part of the auxiliary tool is not radially surrounded by a part of the well string;

performing a selected operation in a borehole when the auxiliary tool is in the working position.

16. The method of claim 15, wherein the opening at the lower end of the upper well string part is formed after disconnecting the lower well string part from the upper well string part.

17. The method of claim 15, further comprising suspendably connecting the auxiliary tool to the lower well string part simultaneously with or before disconnecting the lower well string part from the upper well string part.

18. A well string assembly comprising:

an upper tubular well string part having upper and lower ends between which there is formed a passageway;

a lower well string part having upper and lower ends, which lower end is spaced apart from the lower end of the upper well string part and which lower end is connectable to or includes a drill bit;

a releasable well string interconnection means for selectively interconnecting the lower and upper well string parts above the lower end of the lower well string part; and an auxiliary tool arranged such that it can be passed along the passageway of the upper well string part, wherein the auxiliary tool comprises an operating means for manipulating the well string interconnection means so as to disconnect the lower well string part from the upper well string part, and wherein the auxiliary tool is arranged such that it can be passed, after disconnecting the upper and lower well string parts, through an opening at the lower end of the upper well string part, so as to reach a working position in which at least part of the auxiliary tool is not radially surrounded by a part of the well string, wherein the auxiliary tool further comprises a lower well string connection means for connecting the auxiliary tool to the lower well string part simultaneously with or before disconnecting the well string interconnection means;

a first member which includes the lower well string connection means a second member which includes the operating means, which second member is arranged movably so that it can assume a first and a second position relative to the first member, wherein in the first position the lower well string connection means is connectable, at least when upper and lower well string parts are interconnected, to the lower well string part without operating the well string interconnection means, and wherein after connecting the auxiliary tool to the lower well string part the well string interconnection means can be operated by moving the second member including the operating means between the first and the second position.

19. The well string assembly according to claim 18, wherein the lower well string connection means is arranged near the lower end of the first member, wherein the operating means is arranged near the lower end of the second member, and wherein the second member is arranged longitudinally slideably along the passageway with respect to the first member, so that the first relative position is an upper position of the second member, and wherein the second member is moved relative to the first member in downward direction when moving it towards the second relative position.

20. The well string assembly according to claim 19, wherein the first member of the auxiliary tool comprises a substantially tubular body in which the second member is coaxially slideably arranged, wherein the lower well string part comprises at its upper end an outer sleeve and a coaxial inner sleeve, wherein the upper end of the outer sleeve is arranged to cooperate with the lower well string connection means so as to lock the auxiliary tool to the outer sleeve, wherein the upper end of the inner sleeve is arranged to cooperate with the operating means of the auxiliary tool so that the interconnecting means is operated by longitudinally sliding the inner sleeve with respect to the outer sleeve.

21. The well string assembly according to claim 20, wherein interconnection means, auxiliary tool and the lower well string connection means are arranged such that the lower and upper well string parts can be reconnected again after disconnecting.

22. A method of performing an operation in a borehole, comprising the steps of:

providing a well string assembly in the borehole, the well string assembly comprising an upper tubular well string part having upper and lower ends between which there is formed a passageway and a lower well string part having upper and lower ends, which lower end is spaced apart from the lower end of the upper well string part and which lower end is connectable to or includes a drill bit;

passing an auxiliary tool along the passageway of the upper well string part, thereby manipulating a well string interconnection means and thereby disconnecting the lower well string part from the upper well string part;

positioning the lower one of the lower end of the of the lower well string part or the drill bit at a position in the borehole at a distance above the bottom of the borehole;

subsequently passing the auxiliary tool through an opening at the lower end of the upper well string part;

bringing the auxiliary tool in a working position in which at least part of the auxiliary tool is not radially surrounded by a part of the well string;

performing a selected operation in a borehole when the auxiliary tool is in the working position.

23. The method of claim 22, wherein the opening at the lower end of the upper well string part is formed after disconnecting the lower well string part from the upper well string part.

24. The method of claim 22, further comprising suspendably connecting the auxiliary tool to the lower well string part simultaneously with or before disconnecting the lower well string part from the upper well string part.

* * * * *